United States Patent [19]

Julemont

[11] Patent Number: 4,931,201

[45] Date of Patent: Jun. 5, 1990

[54] WIPING CLOTH FOR CLEANING NON-ABRASIVE SURFACES

[75] Inventor: Jean Julemont, Heusy, Belgium

[73] Assignee: Colgate-Palmolive Company, Piscataway, N.J.

[21] Appl. No.: 239,767

[22] Filed: Sep. 2, 1988

[51] Int. Cl.[5] ..... C11D 17/06; C11D 17/00

[52] U.S. Cl. ..... 252/91; 252/170; 252/134; 252/174; 252/552; 252/DIG. 10; 15/104.93; 15/209 R; 15/214; 15/220 R; 428/245; 428/260; 428/289; 428/341

[58] Field of Search ..... 252/91, 552, 174, 170, 252/DIG. 10; 15/104.93, 209 R, 214, 220 R; 428/227, 245, 252, 260, 272, 288, 289, 290, 340, 341

[56] References Cited

U.S. PATENT DOCUMENTS

| | | | |
|---|---|---|---|
| 3,448,478 | 6/1969 | Nash et al. | 15/104.93 |
| 3,616,157 | 10/1971 | Smith | 161/124 |
| 4,040,989 | 8/1977 | Renaud | 252/548 |
| 4,096,311 | 6/1978 | Pietreniak | 428/269 |
| 4,100,324 | 7/1978 | Anderson et al. | 428/288 |
| 4,232,128 | 11/1980 | Michel et al. | 521/134 |
| 4,426,417 | 3/1983 | Meitner et al. | 428/195 |
| 4,448,704 | 5/1984 | Barby et al. | 252/91 |
| 4,587,154 | 6/1986 | Hotchkiss et al. | 428/195 |
| 4,600,620 | 7/1986 | Lloyd et al. | 428/195 |
| 4,627,936 | 12/1986 | Gould et al. | 252/558 |
| 4,666,621 | 5/1987 | Clark et al. | 252/91 |
| 4,725,489 | 2/1988 | Jones et al. | 428/289 |

FOREIGN PATENT DOCUMENTS

| | | |
|---|---|---|
| 0067016 | 12/1982 | European Pat. Off. . |
| 0211664 | 2/1986 | European Pat. Off. . |

*Primary Examiner*—Paul Lieberman
*Assistant Examiner*—Kathleen Markowski
*Attorney, Agent, or Firm*—Richard J. Ancel; Robert C. Sullivan; Murray M. Grill

[57] ABSTRACT

A non-woven, fabric-like multifunctional cloth for household cleaning with high absorption capacity, minimum tearing resistance and a unique scrubbing and wiping efficacy. This cloth comprises a homogeneous mixture of wood pulp fibers and polypropylene microfibers impregnated with an all purpose cleaner.

1 Claim, No Drawings

WIPING CLOTH FOR CLEANING NON-ABRASIVE SURFACES

FIELD OF INVENTION

This invention relates to nonwoven wiping and cleaning articles impregnated with a cleaner solution for use in light duty household cleaning of non-abrasive surfaces such as kitchen counters, doors, furniture and appliances.

BACKGROUND OF THE INVENTION

There are many household cleaning and wiping products that are available to the consumer today. Ordinary detergents and waxes can be utilized to aid the housekeeper in the daily chores of cleansing and polishing. Items such as sponges, paper towels and soft cloths can be employed in conjunction with the varies cleaners. However, the use of paper products or sponges with cleaning agents is usually costly since one wiping product is restrictive to use with one specific cleaning product. Also where one is seeking to clean a variety of items the requirement of a two step process of applying a cleaner to the surface wiping and rinsing the surface with a cloth or sponge is generally a tedious task.

There are numerous products on the market today that save time and provide an easy method of cleaning. These products provide absorbent substrates impregnated with liquid compositions.

However, although these impregnated substrates are more convenient, they have a disadvantage in that one substrate must be used for one different task. For instance, when one cleans the kitchen and bathroom, one may use the article for cleaning described in EP Patent No. 0211,664. This cleaning aid is comprised of a sheet, sponge or pad and contains a core compound which is a nonionic surfactant. U.S. Pat. No. 4,725,489 describes a wipe that can be used solely in a bathroom. To clean glass surfaces one may utilize a wipe described in U.S. Pat. Nos. 4,666,621 and 4,448,704, which provide streak-free cleaning. There are also wipes that generally pick up dirt that contain an oil as described in U.S. Pat. No. 3,448,478 and also wipes that have an antistatic agent impregnated substrate as described in U.S. Pat. No. 4,627,936.

So one can see that although the two step process is eliminated by use of the afore mentioned wipes, the number of wipes needed in order t accomplish household chores may be volumious.

Each of these products mentioned above have a variety of different substrate bases with a specific compound impregnated therein in order to perform the task which they hope to accomplish. For instance, in U.S. Pat. No. 4,448,704 the substrate is comprised of a nonwoven fabric or paper and the compound impregnated therein includes a surface active agent and a partially esterified resin. This article is produced by a process which includes prewashing the substrate to remove any streak forming impurities. This wipe is therefore, especially designed to use on glass surfaces.

Other substrate material designed to accomplish the specific task are illustrated in U.S. Pat. Nos. 4,600,620, 4,232,128, and 3,616,157. Specifically use of a core material of bulky high porous fibers sheet material and a wiping surface having flatten areas of thermoplastic coating as a substrate, as described in U.S. Pat. No. 4,600,620, has a particular surface construction that gives advantages in the wiping of hard glossy surfaces.

A cellulose hydrate and ten to eighty percent polyolefin fiber substrate as described in U.S. Pat. No. 4,232,128, is especially useful for cleaning water repellant surfaces and for removing stains. An embossed nonwoven fabric substrate, as described in U.S. Pat. No. 3,616,157 is useful for wiping and cleaning material for aqueous and/or oleaginous liquids. Varies compounds which are impregnated in these specific substrates include anionic, nonionic surfactant, viscous semisolids, granules, wax, and silicone. These compounds vary with the task that the wipe is supposed to perform.

However, none of the above mentioned products offer a wipe that can be used in a variety of household tasks such as cleaning furniture, kitchen surfaces and appliances, bathroom surfaces and appliances, and doors. Thus there is a need in the art to provide a multifunctional wipe for use in household cleaning that is disposable.

SUMMARY OF THE INVENTION

The present invention fills an important need in the art by providing a multifunctional disposable wipe for cleaning nonabrasive surfaces. Generally described, the present wipe comprises a homogenous mixture of wood pulp fibers, and polypropylene microfibers impregnated with a microemulsion. The microemulsion may consist of any surfactant, cosurfactant and other additives such as coconut oil and perfume and is present in a 10% water concentration.

Thus it is an object of the present invention to provide a one step process for cleaning a variety of non-abrasive surfaces in the household.

It is a further object of this invention to provide a cleaning wipe which has good absorption capacity as well as excellent cleaning ability.

It is a further object of this invention to provide a cleaning wipe that leaves no drop residue and has minimum tearing resistance.

It is yet another object of this invention to provide a multifunctional disposable wipe that may be used with o without adding water.

Other object, features advantages of the present invention will become apparent upon reading the following detailed description of embodiments of the invention taken in conjunction with the appended claims.

DETAILED DESCRIPTION

The semi-moist wipes of this invention comprise an absorbent substrate carrying an aqueous liquid composition which is impregnated into the substrate. These wipes are useful for one-step cleaning of a variety of household surfaces. These household surfaces include doors, furniture kitchen surfaces, appliances, bathroom surfaces, faucets, and more generally all non-abrasive surface.

The present wipes may be used with or without water and are disposable. Their contemplated use is for general light duty household cleaning and soil removal.

The substrate size may be between 25 cm×25 cm to 45 cm×45 cm, but preferably 36 cm×36 cm. The composition of the substrate consists of an isotropic mixture of a polymeric microfiber with a fiber diameter of less than 10 microns mixed with woodpulp or cellulosic (micro)fiber, which particular substrate is preferably made in accordance with U.S. Pat. No. 4,100,324 to Anderson, Sokolowski and Ostermeier dated July 11, 1978, which is incorporated herein by reference. The product of the said patent is sold and is identified as Kimcel. The woodpulp or cellulosic fiber may be present in the range of 90:10 % by weight to 10:90 % by weight of microfiber to woodpulp or cellulosic fiber, but preferably in the range of 65:35 percent by weight. The weight of the substrate may range from 50 grams to 150 grams, but preferrably from 70 grams/sqm.

The maximum quantity of a liquid which can be carried by an absorbent substrate is determined by the total capacity of the substrate to carry said liquid without dripping. This quantity can be termed absorbence capacity. For use in this invention, the substrate should have an absorption capacity in the range of 5.0gram/-gram substrate to 15 grams/gram substrate, but preferably 7.9 grams/gram substrate.

Any liquid cleaning composition may be utilized with the substrate to give similar cleaning results. However, based on microemulsion technology, the preferred cleaning composition is in the form of a microemulsion comprising a surfactant, water, diethylene glycol monobutyl ether and other additives. The preferred microemulsion comprises 0.5% fatty acid or distilled coconut oils 0.05% solution of 38% $Na_2O$, 6.67% $C_{14-17}$ Na Paraffin sulfonate, in a 60% solution, 4% being nominal, 3.0% $C_{13-15}$ fatty alcohol ethylene oxide (in a 7:1 ratio and propylene oxide (in a 4:1 ratio) 1.5% magnesium sulfate Heptahydrate, 2.0% formalin, 3.5% Diethylene glycol monobutyl ether, 0.6% to 2.0% perfume and the balance being deionized or tapwater.

The level of impregnation of the microemulsion to the substrate is about 3 grams of a 10 % solution of the cleaner per gram substrate. This particular level of impregnation was chosen to allow consumers to clean surfaces with or without additional water. The 10% concentration of the cleaning detergent displays a high cleaning efficacy, lack of trace residue and easy rinsability.

The cleaning efficacy displayed by the present invention is 6 strokes based upon the Gardner method using a 5% chloroformic solution of beef grease. However, the cleaning efficacy. through the scrubbing action may be in the range of 1-10 strokes.

The present invention displays a minimum tearing resistance while wet of MD — 3.0 N/inch and CD — 3.0N/inch The specific substrate of the present invention was chosen because of its superiority in absorption, its strength, and its superior cleaning and wiping performance. The following table summarizes the results of certain properties of the present substrate compared with other substrates

| | Absorption Capacity | | Gardner (sol. 5%) Number of | | Tearing resistance wet (N/inch) | |
|---|---|---|---|---|---|---|
| | gr/gr | gr/sqm | Strokes | Wiping | MD | CD |
| Kimcel (73 g/sqm) | 7.9 | 577 | 6 | OK | 8.5 | 5.5 |
| Dry laid paper (80 g/sqm) | 5.6 | 448 | 25 | IK | 3.8 | 3.9 |
| Kendal Hef (50 g/sqm) | 7.2 | 360 | 10 | Drop residues | 45.0 | 8.0 |

These results indicate that Kimcel displays superior results over other known substrates. Its absorption capacity is higher, compared to dry laid paper and Kendal Hef. due to the surface of the polyproylene microfibers having an increase in specific surface area and consequently higher absorption capacity.

The cleaning performance, is also superior to the other two substrates as indicated by 6 strokes in the Gardner test.

Wiping performance is also superior due to the very high absorption capacity of the Kimcel wipe and the chamois-type surface that retrieves droplets and leaves the surface droplet-free.

The thermal bonding process that melts the polypropylene microfibers gives the web of the Kimcel substrate its integrity and resistance. The fibers in the non-bonded areas remain completely free providing fluffiness and absorption, while the fibers in the bonded area are fused and remain flat. The ratio of bonded to non-bonded areas is 1 to 9.

It can be readily seen, that the wipes according to this invention give excellent absorption and cleaning results a compared to the other substrates.

I claim:

1. A semi-moist disposable wiping cloth for cleaning non-abrasive surfaces consisting essentially of 10-90% polymeric microfibers and 10-90% cellulose microfibers impregnated with about 3 grams of a 10 percent microemulsion consisting essentially of 0.5 percent fatty acid or distilled coconut oil, 0.05 percent of a 38 percent solution of $Na_2O$, 6.67 percent $C_{14-17}$ sodium paraffin sulfonate in a 60 percent solution, 3 percent $C_{13-15}$ fatty alcohol ethylene oxide, 1.5 percent magnesium sulfate heptahydrate, 2 percent formalin, 3.5 percent diethylene glycol monobutyl ether, 0.6 to 2 percent perfume and the balance of water, per gram of substrate.

* * * * *